US012410529B2

(12) United States Patent
Ho et al.

(10) Patent No.: US 12,410,529 B2
(45) Date of Patent: Sep. 9, 2025

(54) YOLK-SHELL NANOSTRUCTURE AND METHOD OF FABRICATING THE SAME

(71) Applicant: City University of Hong Kong, Hong Kong (HK)

(72) Inventors: Johnny Chung Yin Ho, Hong Kong (HK); Xiuming Bu, Hong Kong (HK)

(73) Assignee: City University of Hong Kong, Hong Kong (HK)

( * ) Notice: Subject to any disclaimer, the term of this patent is extended or adjusted under 35 U.S.C. 154(b) by 500 days.

(21) Appl. No.: 18/150,210

(22) Filed: Jan. 5, 2023

(65) Prior Publication Data

US 2024/0229263 A1 Jul. 11, 2024

(51) Int. Cl.
*C25B 11/091* (2021.01)
*C25B 1/04* (2021.01)

(52) U.S. Cl.
CPC ..... *C25B 11/091* (2021.01); *C25B 1/04* (2013.01)

(58) Field of Classification Search
CPC ..... C25B 1/04; C25B 11/091
See application file for complete search history.

(56) References Cited

PUBLICATIONS

X. Zou, Y. Zhang, Noble metl-free hydrogen evolution catalysts for water splitting, Chem. Soc. Rev. 2015, 44, 5148-5180.

M. Fang, G. Dong, R. Wei, J. C. Ho, Hierarchical Nanostructures: Design for Sustainable Water Splitting, Adv. Energy Mater. 2017, 7, 1700559.

X. Bu, Y. Li, J. C. Ho, Efficient and stable electrocatalysts for water splitting, MRS Bull. 2020, 45, 531-538.

A. Parra-Puerto, K. L. Ng, K. Fahy, A. E. Goode, M. P. Ryan, A. Kucernak, Supported Transition Metal Phosphides: Activity Survey for HER, ORR, OER, and Corrosion Resistance in Acid and Alkaline Electrolytes, ACS Catal. 2019, 9, 11515-11529.

J. Zhang, Q. Zhang, X. Feng, Support and Interface Effects in Water-Splitting Electrocatalysts, Adv. Mater. 2019, 31, 1808167.

M. F. Lagadec, A. Grimaud, Water electrolysers with closed and open electrochemical systems, Nat. Mater. 2020, 19, 1140.

X. Bu, R. Wei, W. Gao, C. Lan, J. C. Ho, J. A unique sandwich structure of a CoMnP/Ni2P/NiFe electrocatalyst for highly efficient overall water splitting†, Mater. Chem. A 2019, 7, 12325-12332.

W. Tong, M. Forster, F. Dionigi, S. Dresp, R. Sadeghi Erami, P. Strasser, A. J. Cowan, P. Farras, Electrolysis of low-grade and saline surface water, Nat. Energy 2020, 5, 367.

J. E. Bennett, Electrodes for Generation of Hydrogen Andoxygen From Seawater, Int. J. Hydrogen Energy 1980, 5, 401-408.

(Continued)

*Primary Examiner* — Brian A McCaig
(74) *Attorney, Agent, or Firm* — Idea Intellectual Limited; Sam T. Yip

(57) ABSTRACT

A design of efficient and robust electrocatalysts for hydrogen evolution reaction (HER) under all pH conditions is provided. Especially, the present invention provides a yolk-shell nanostructure with Rh nanoparticles embedded in S, N co-doped carbon nanostructures prepared by a facile self-template method. The obtained nanostructures can achieve an extremely small overpotential of 10-20 mV at 10 mA $cm^{-2}$, a Tafel slope of 20-30 mV $dec^{-1}$, a TOF of 0.1-0.3 $s^{-1}$ (at −75 mV/RHE) and long-term durability more than 10 hours.

16 Claims, 20 Drawing Sheets

(56) References Cited

PUBLICATIONS

H. Xu, J. Wan, H. Zhang, L. Fang, L. Liu, Z. Huang, J. Li, X. Gu, Y. Wang, A New Platinum-Like Efficient Electrocatalyst for Hydrogen Evolution Reaction at All pH: Single-Crystal Metallic Interweaved V8C7 Networks, Adv. Energy Mater. 2018, 8, 1800575.

M. Fang, W. Gao, G. Dong, Z. Xia, S. P. Yip, Y. Qin, Y. Qu, J. C. Ho, Hierarchical NiMo-based 3D electrocatalysts for highly-efficient hydrogen evolution in alkaline conditions, Nano Energy 2016, 27, 247-254.

J. Yang, W. Li, S. Tan, K. Xu, Y. Wang, D. Wang, Y. Li, The Electronic Metal-Support Interaction Directing the Design of Single Atomic Site Catalysts: Achieving High Efficiency Towards Hydrogen Evolution, Angew. Chemie—Int. Ed. 2021, 60, 19085-19091.

P. Zhu, X. Xiong, D. Wang, , Regulations of active moiety in single atom catalysts for electrochemical hydrogen evolution reaction, Nano Res. 2022, 15, 5792-5815.

K. Wang, B. Huang, F. Lin, F. Lv, M. Luo, P. Zhou, Q. Liu, W. Zhang, C. Yang, Y. Tang, Y. Yang, W. Wang, H. Wang, S. Guo, Wrinkled Rh2P Nanosheets as Superior pH-Universal Electrocatalysts for Hydrogen Evolution Catalysis, Adv. Energy Mater. 2018, 8, 1801891.

Z. Li, Y. Feng, Y. L. Liang, C. Q. Cheng, C. K. Dong, H. Liu, X. W. Du, Stable Rhodium (IV) Oxide for Alkaline Hydrogen Evolution Reaction, Adv. Mater. 2020, 32, 1908521.

J. N. Hansen, H. Prats, K. K. Toudahl, N. Mørch Secher, K. Chan, J. Kibsgaard, I. Chorkendorff, Is There Anything Better than Pt for HER?, ACS Energy Lett. 2021, 6, 1175-1180.

Z. W. She, J. Kibsgaard, C. F. Dickens, I. Chorkendorff, J. K. Nørskov, T. F. Jaramillo, Combining theory and experiment in electrocatalysis: Insights into materials design, Science 2017, 355, 146 (2017).

N. Danilovic, R. Subbaraman, D. Strmcnik, V. R. Stamenkovic, N. M. Markovic, Electrocatalysis of the HER in acid and alkaline media, J. Serbian Chem. Soc. 2013, 78, 2007.

Y. Y. Ma, C. X. Wu, X. J. Feng, H. Q. Tan, L. K. Yan, Y. Liu, Z. H. Kang, E. B. Wang, Y. G. Li, Highly efficient hydrogen evolution from seawater by a low-cost and stable CoMoP@C electrocatalyst superior to Pt/C, Energy Environ. Sci. 2017, 10, 788-798.

Y. Xiong, J. Dong, Z. Q. Huang, P. Xin, W. Chen, Y. Wang, Z. Li, Z. Jin, W. Xing, Z. Zhuang, J. Ye, X. Wei, R. Cao, L. Gu, S. Sun, L. Zhuang, X. Chen, H. Yang, C. Chen, Q. Peng, C. R. Chang, D. Wang, Y. Li, Single-atom Rh/N-doped carbon electrocatalyst for formic acid oxidation, Nat. Nanotechnol. 2020, 15, 390-400.

J. K. Nørskov, T. Bligaard, A. Logadottir, J. R. Kitchin, J. G. Chen, S. Pandelov, U. Stimming, Trends in the Exchange Current for Hydrogen Evolution, Journal of the Electrochemical Society, 2005, 152, 23-26.

Q. Wang, C. Q. Xu, W. Liu, S. F. Hung, H. Bin Yang, J. Gao, W. Cai, H. M. Chen, J. Li, B. Liu, Coordination engineering of iridium nanocluster bifunctional electrocatalyst for highly efficient and pH-universal overall water splitting, Nat. Commun. 2020, 11, 4246.

G. S. Karlberg, T. F. Jaramillo, E. Skulason, J. Rossmeisl, T. Bligaard, J. K. Nørskov, Cyclic Voltammograms for H on Pt(111) and Pt( 100) from First Principles, Phys. Rev. Lett. 2007, 99, 126101.

H. Xia, Z. Huang, C. Lv, C. Zhang, A Self-Supported Porous Hierarchical Core-Shell Nanostructure of Cobalt Oxide for Efficient Oxygen Evolution Reaction, ACS Catal. 2017, 7, 8205-8213.

J. Zhang, W. Xiao, P. Xi, S. Xi, Y. Du, D. Gao, J. Ding, Activating and Optimizing Activity of CoS2 for Hydrogen Evolution Reaction through the Synergic Effect of N Dopants and S Vacancies, ACS Energy Lett. 2017, 2, 1022-1028.

Y. Chen, H. Li, J. Wang, Y. Du, S. Xi, Y. Sun, M. Sherburne, J. W. Ager, A. C. Fisher, Z. J. Xu, Exceptionally active ridium evolved from a pseudocubic perovskite for oxygen evolution in acid, Nat. Commun. 2019, 10, 572.

P. Hou, D. Li, N. Yang, J. Wan, C. Zhang, X. Zhang, H. Jiang, Q. Zhang, L. Gu, D. Wang, Delicate Control on the Shell Structure of Hollow Spheres Enables Tunable Mass Transport in Water Splitting, Angew. Chemie—Int. Ed. 10.1002/anie.202016285.

Xiuming Bu et al., Adv Funct Materials, Superior Electrocatalyst for All-pH Hydrogen Evolution Reaction: Heterogeneous Rh/N and S Co-Doped Carbon Yolk-Shell Nanospheres, 2022, 32, 2206006.

$Rh_5$/NSC YSS $Rh_{15}$/NSC YSS $Rh_{30}$/NSC YSS

YOLK-SHELL NANOSTRUCTURE AND METHOD OF FABRICATING THE SAME

FIELD OF THE INVENTION

The invention relates to the technical field of nanomaterials. More specifically, the present invention relates to a yolk-shell nanostructure and methods for preparing the same.

BACKGROUND OF THE INVENTION

Electrochemical water splitting to hydrogen powered by using renewable energy sources, instead of fossil fuels, is widely considered as one of the promising high energy density carriers for clean power in future. Up until now, platinum (Pt)-based nanomaterials have served as the most effective electrocatalysts for hydrogen evolution reaction (HER) due to their hydrogen adsorption free energy ($\Delta G_H$) being close to zero, requiring only a small overpotential to produce hydrogen. However, the poor stability and unsatisfactory performance of Pt in non-acidic conditions greatly hinders its widespread practical application. For example, the HER kinetics of Pt in alkaline solutions is about 2 to 3 orders of magnitude lower than that in acidic conditions.

Because of different requirements in different electrolyzer systems (e.g., acidic media for proton-exchange membrane-based water electrolyzers, near-neutral media for microbial electrolysis cells and alkaline medium for alkaline electrolyzers), as well as the intense local pH change on the electrode surface during reaction, an effective HER electrocatalyst must perform well over a wide pH range. Although tremendous efforts have been devoted to develop pH-universal electrocatalysts with high electrochemical performance and robust stability, even in terms of the current density calculated based on geometric surface (electrode surface area), very few of them can achieve comparable activities to commercial Pt/C electrocatalysts. In this regard, it is still challenging to develop pH-universal electrocatalysts with HER activities and stability that exceed those of commercial Pt/C materials.

Recent studies have found that rhodium (Rh)-based nanomaterials may replace Pt to serve as another promising candidate for pH-universal HER electrocatalysts. For example, Guo et al. reported the preparation of monodisperse $Rh_2P$ nanoparticles via a colloidal method, in which the nanoparticles showed excellent HER performance in a wide pH range. In addition, Du et al. used a laser ablation method to synthesize compressed $RhO_2$ clusters embedded in Rh nanoparticles; the catalysis performance indicated that Rh-based noble metals are superior for alkaline HER. Nevertheless, the preparation methods/techniques employed in the aforementioned are complex, time-consuming, and expensive.

Thus, there is a need in the art to develop an improved nanostructure and a simple, low-cost, and scalable method for fabricating such nanostructure. The present invention addresses this need.

The following reference list sets forth the literature mentioned in this section, which are incorporated herein by reference in their entirety:

1. K. Wang, B. Huang, F. Lin, F. Lv, M. Luo, P. Zhou, Q. Liu, W. Zhang, C. Yang, Y. Tang, Y. Yang, W. Wang, H. Wang, S. Guo, Adv. Energy Mater. 2018, 8, 1.

2. Z. Li, Y. Feng, Y. L. Liang, C. Q. Cheng, C. K. Dong, H. Liu, X. W. Du, Adv. Mater. 2020, 32, 1.

SUMMARY OF THE INVENTION

In accordance with one aspect of the present invention, there is provided a yolk-shell nanostructure, which includes a yolk core comprising Rh nanoparticles; and a carbon shell encapsulating the yolk core. The carbon shell is co-doped with sulfur and nitrogen nanoparticles. The obtained yolk-shell nanostructure has an overpotential of 10-20 mV at 10 mA $cm^{-2}$, a Tafel slope of 20-30 mV $dec^{-1}$, a TOF of 0.1-0.3 $s^{-1}$ at −75 mV/RHE, and a long-term durability more than 10 hours.

In a first embodiment of the first aspect of the present invention, the yolk-shell nanostructure has a particle size of 1-300 nm. Preferably, the yolk-shell nanostructure has a particle size of 30-250 nm.

In a second embodiment of the first aspect of the present invention, the yolk-shell nanostructure has a water contact angle between 10 degrees to 40 degrees. Preferably, the yolk-shell nanostructure has a water contact angle between 10 degrees to 20 degrees.

In a third embodiment of the first aspect of the present invention, the thickness of the yolk-shell nanostructure is in a range of 1 to 10 nm.

In accordance with another aspect of the present invention, there is provided a method for fabricating a yolk-shell nanostructure, including dissolving $RhCl_3$ and thiourea in distilled water separately to form a $RhCl_3$ solution and a thiourea solution; adding the $RhCl_3$ solution to the thiourea solution slowly under stirring until obtaining a transparent mixture solution; performing a hydrothermal reaction on the mixture solution; cooling the solution to room temperature and gathering brown precipitates from the solution and washing with ethanol and deionized water; drying the brown precipitates under vacuum overnight; and transforming the brown precipitates into the yolk-shell nanostructure in air atmosphere by heat treating.

In a first embodiment of the second aspect of the present invention, a mass ratio between $RhCl_3$ and thiourea is in a range of 15:1 to 2:1.

In a second embodiment of the second aspect of the present invention, a working temperature during the hydrothermal reaction is in a range of 120° C. to 180° C.

In a third embodiment of the second aspect of the present invention, a working time during the hydrothermal reaction is in a range of 1 to 48 hours.

In a fourth embodiment of the first aspect of the present invention, the step of drying the brown precipitates under vacuum overnight is carried out at 50° C. to 70° C.

In a fifth embodiment of the second aspect of the present invention, a working temperature during the heat treating process is in a range of 300° C. to 800° C.

In a sixth embodiment of the second aspect of the present invention, a working time during the heat treating process is in a range of 1 to 48 hours.

In a seventh embodiment of the second aspect of the present invention, the heat treating process has a heating rate of 2° C. $min^{-1}$.

The present invention has the following advantages:

(1) the product exhibited excellent and stable hydrogen evolution reaction at all pH values;

(2) the mass content of the noble metal in the final obtained product is low;

(3) the hydrogen evolution reaction performance of the final product is better than that of the commercialized Pt/C and Rh/C electrocatalyst; and (4) the preparation process is simple, low-cost, and scalable.

BRIEF DESCRIPTION OF THE DRAWINGS

Embodiments of the invention are described in more details hereinafter with reference to the drawings, in which.

DETAILED DESCRIPTION OF THE INVENTION

Definitions

Figure 1:
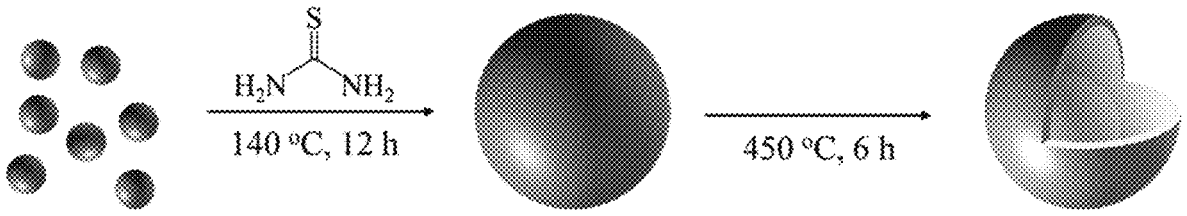
FIG. 1 shows a schematic diagram of the preparation process of $Rh_x$/NSC yolk-shell nanostructure ($Rh_x$/NSC YSS)

Throughout this specification, unless the context requires otherwise, the word "comprise" or variations such as "comprises" or "comprising", will be understood to imply the inclusion of a stated integer or group of integers but not the exclusion of any other integer or group of integers. It is also noted that in this disclosure and particularly in the claims and/or paragraphs, terms such as "comprises", "comprised", "comprising" and the like can have the meaning attributed to it in U.S. patent law; e.g., they allow for elements not explicitly recited, but exclude elements that are found in the prior art or that affect a basic or novel characteristic of the present invention.

Furthermore, throughout the specification and claims, unless the context requires otherwise, the word "include" or variations such as "includes" or "including", will be understood to imply the inclusion of a stated integer or group of integers but not the exclusion of any other integer or group of integers.

References in the specification to "one embodiment", "an embodiment", "an example embodiment", etc., indicate that the embodiment described can include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

Other definitions for selected terms used herein may be found within the detailed description of the present invention and apply throughout. Unless otherwise defined, all other technical terms used herein have the same meaning as commonly understood to one of ordinary skill in the art to which the present invention belongs.

In order to address the objectives and needs discussed above, the present invention provides a yolk-shell nanostructure with Rh nanoparticles embedded in S, N co-doped carbon nanostructures for efficient hydrogen evolution reactions. The preparation process of the $Rh_x$/NSC YSS (x=5, 10, 15, 20, or 30) is conducted with a self-template method. The $Rh_x$/NSC YSS precursor is first obtained with the nanostructure through a facile hydrothermal method by using $RhCl_3$ and thiourea as the Rh, N, S and C sources. Then, the precursor is in-situ transformed into $Rh_x$/NSC YSS nanostructure by a heat treatment in air atmosphere.

The obtained nanostructures can achieve an overpotential of 10-20 mV at 10 mA $cm^{-2}$, a Tafel slope of 20-30 mV $dec^{-1}$, high turnover frequency (TOF) of 0.1-0.3 $s^{-1}$ (at −75 mV vs. reversible hydrogen electrode), and long-term durability for more than 10 hours, which is the record-high alkaline HER activity among the ever-reported noble metal-based catalysts.

Preferably, the obtained nanostructures has an overpotential of 13.5 mV at 10 mA $cm^{-2}$, a Tafel slope of 25.5 mV $dec^{-1}$, high turnover frequency (TOF) of 0.143 $s^{-1}$ (at −75 m V vs. reversible hydrogen electrode).

In some embodiments, the yolk-shell nanostructure has a particle size of 1-300 nm, more particularly, 30-250 nm. The water contact angle is between 10 to 40 degrees, more particularly, between 10 to 20 degrees. A thickness of the yolk-shell nanostructure may be in the range of 1 to 10 nm.

The methods for fabricating the yolk-shell nanostructures are low-cost, simple, and reproduceable, making them suitable for large-scale production. The method involves precipitating the nanomaterials followed by heat treatment. In a first aspect, a rhodium salt such as $RhCl_3$ is dissolved in a suitable solvent, such as water. A separate thiourea solution is formed; similarly, the thiourea may use water as the solvent. and thiourea in distilled water separately to form a $RhCl_3$ solution and a thiourea solution The rhodium salt solution is slowly added to the thiourea solution with agitation to obtain a transparent mixture. A hydrothermal reaction is performed on the mixture, followed by cooling to room temperature, causing the formation of precipitates. The precipitates are recovered and washed, followed by drying for at least approximately 12 hours, preferably under vacuum conditions. The precipitates, which typically exhibit a brown color, a transformed into a yolk-shell nanostructure through heat treatment in the ambient atmosphere.

In one aspect, the mass ratio between $RhCl_3$ and thiourea is in a range of 15:1 to 2:1 and the temperature during the hydrothermal reaction is in a range of 120° C. to 180° C. The time of the hydrothermal reaction is in a range of 1 to 48 hours.

In one embodiment, the drying of the precipitates may be overnight and under vacuum at a temperature of approximately 50° C. to 70° C. The heat treatment may occur at a temperature of approximately 300° C. to 800° C. and for a time of 1 to 48 hours. To reach the final heat treatment temperature, the temperature may increase at a rate of approximately 2° C. $min^{-1}$ until the final heat treatment temperature is reached.

EXAMPLES

Example 1—Fabrication of $Rh_{15}$/NSC Yolk-Shell Nanostructures ($Rh_{15}$/NSC YSS)

15 mg of $RhCl_3$ and 2 g of thiourea were dissolved in 10 mL of distilled water, respectively. The $RhCl_3$ solution was then added to the thiourea solution slowly under stirring until the clear transparent solution was obtained. The mixture solution was sealed into a 35 mL Teflon-lined stainless steel autoclave reactor, which was next heated at 140° C. for 12 hours in an electric oven. After cooling the system to room temperature naturally, the brown precipitates were gathered and washed several times with ethanol and deionized water by centrifugation, followed by vacuum dried at 60° C. overnight. Finally, the $Rh_{15}$/NSC yolk-shell nanostructures ($Rh_{15}$/NSC YSS) were transformed from brown precipitates by a heat treatment method in air atmosphere at 450° C. for 6 hours with a heating rate of 2° C. $min^{-1}$ (FIG. 1).

For comparison, other $Rh_x$/NSC YSS (x=5, 10, 20 and 30) were also prepared as control samples using the same methods except for changing the feeding amount of $RhCl_3$ for 5 mg, 10 mg, 20 mg and 30 mg, respectively.

Example 2—Assessment of the Crystallinity and Structure of $Rh_{15}$/NSC YSS The purity and crystalline structure of prepared samples were evaluated by powder X-ray diffraction (XRD) with a scan rate of 0.05° $s^{-1}$ in a 2θ scan ranging from 20° to 90° using a Bruker D2 Phaser (Bruker, Billerica, MA, USA) instrument equipped with a monochromatic Cu-Kα radiation.

Figure 2:
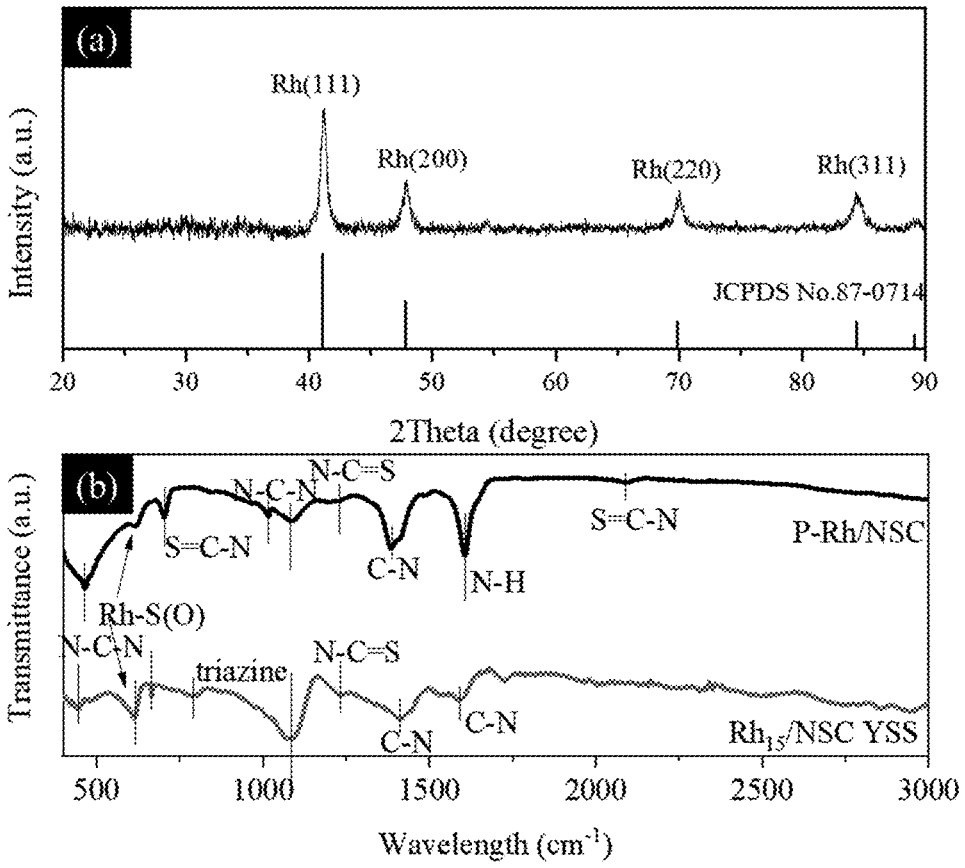
FIG. 2 depicts XRD spectra (top) and FTIR pattern (bottom) of $Rh_{15}$/NSC YSS in accordance with one embodiment of the present invention.

Referring to FIG. 2, as illustrated in the XRD pattern, the crystallographic structure of the obtained $Rh_{15}$/NSC YSS could be matched well with the standard pattern of cubic Rh phase (JCPDS NO. 87-0714). When combined with FT-IR spectra, it can be seen that the sharp peak around 611 $cm^{-1}$ is caused by Rh—S(O), indicating the strong electronic effect between Rh and S, N co-doped carbon.

Figure 3A:
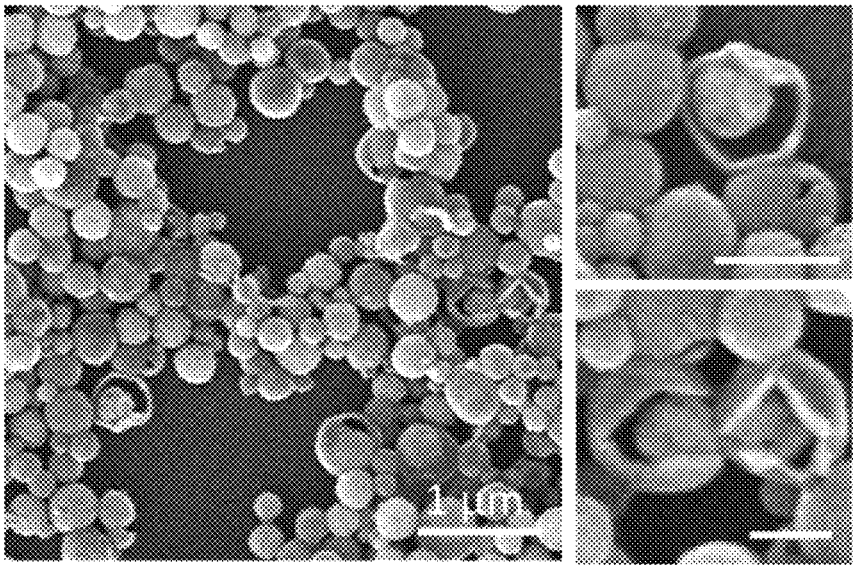
FIG. 3A shows scanning electron microscope (SEM) images of the $Rh_{15}$/NSC YSS. The scale bar length is 100 nm.
Figure 3B:
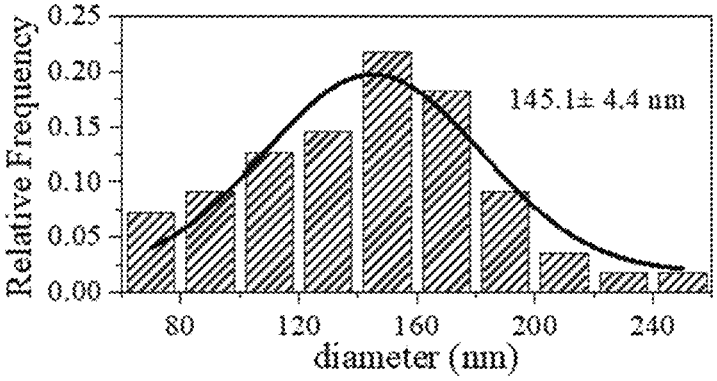
FIG. 3B depicts size distribution of the $Rh_{15}$/NSC YSS.
Figure 3C:
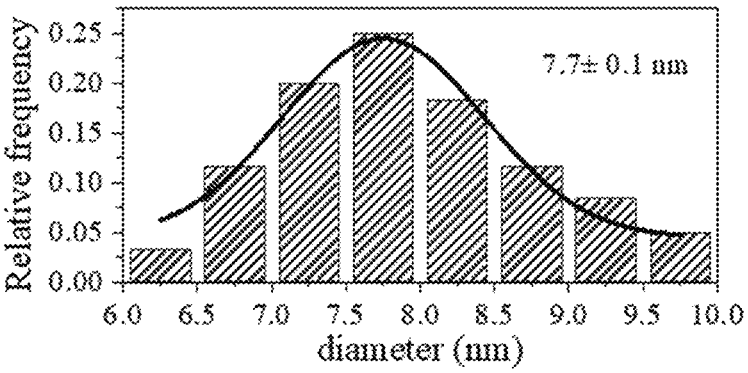
FIG. 3C depicts shell thickness distribution of the $Rh_{15}$/NSC YSS.

The morphology and dimension of obtained products were observed by scanning electron microscopy (SEM, Phenom Pro, Phenom-World, The Netherlands) with an accelerating voltage of 10 kV and field-emission SEM (SU-8010, Hitachi, Tokyo, Japan) with an accelerating voltage of 15 kV. The SEM image of $Rh_{15}$/NSC YSS was shown in FIG. 3A. The results showed that the average size of the prepared $Rh_{15}$/NSC YSS was 145.1±4.4 nm (FIG. 3B), and the shell thickness of the prepared $Rh_{15}$/NSC YSS was 7.7±0.1 nm (FIG. 3C).

Figure 3D:
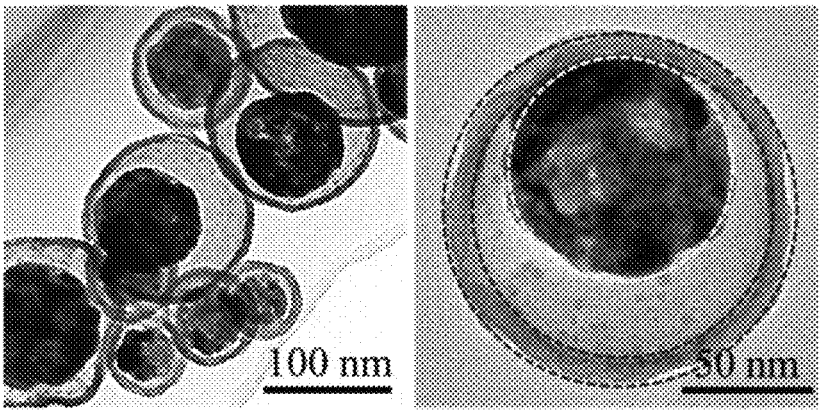
FIG. 3D shows transmission electron microscope (TEM) images of the $Rh_{15}$/NSC YSS with different magnification.
Figure 3E:
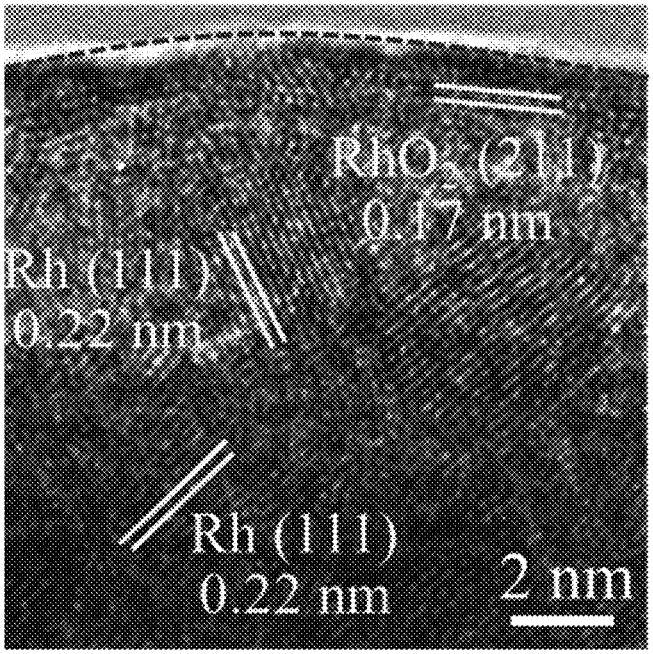
FIG. 3E shows high-resolution transmission (HRTEM) image of the $Rh_{15}$/NSC YSS.

In addition, the interior structure of as obtained $Rh_{15}$/NSC YSS was further elucidated by transmission electron microscopy (TEM) (FIG. 3D). The high-resolution transmission electron microscopy (HRTEM) image showed a representative interplanar spacing of 0.22 nm, suggesting the association with (111) plane of the cubic Rh phase. In addition to (111) plane, several atomic layers of $RhO_2$ (with the lattice spacing of 0.17 nm corresponding to (211) plane of $RhO_2$, JCPDS NO. 43-1026) was also observed on the surface of $Rh_{15}$/NSC YSS (FIG. 3E).

Figure 3F:
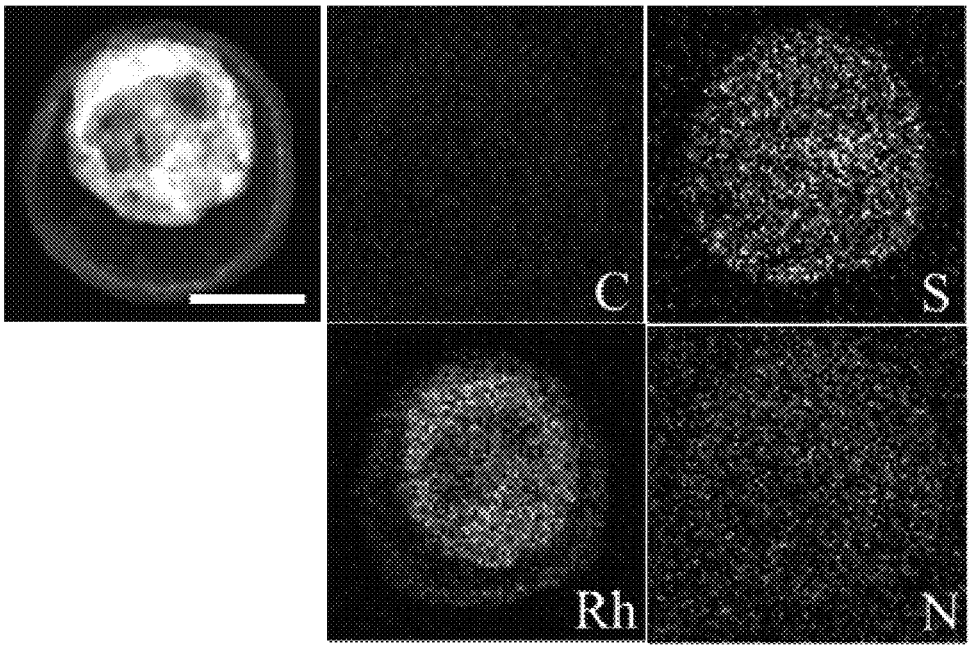
FIG. 3F shows high-angle annular dark field (HAADF) STEM image and corresponding elemental mapping of C, Rh, S and N of the $Rh_{15}$/NSC YSS. The scale bar length is 50 nm.

Moreover, the high-angle annular dark field (HAADF) STEM image clearly proved the porosity and heterogeneity of the nanostructure. It was obvious in FIG. 3F that the core of the nanostructure has a higher Rh content compared to the shell. Elemental mappings of the $Rh_{15}$/NSC YSS indicates that C, Rh, S and N elements are unevenly distributed on the surface.

Example 3—Effect of Changing the Mass Ratio of $RhCl_3$ and Thiourea

Figure 4:
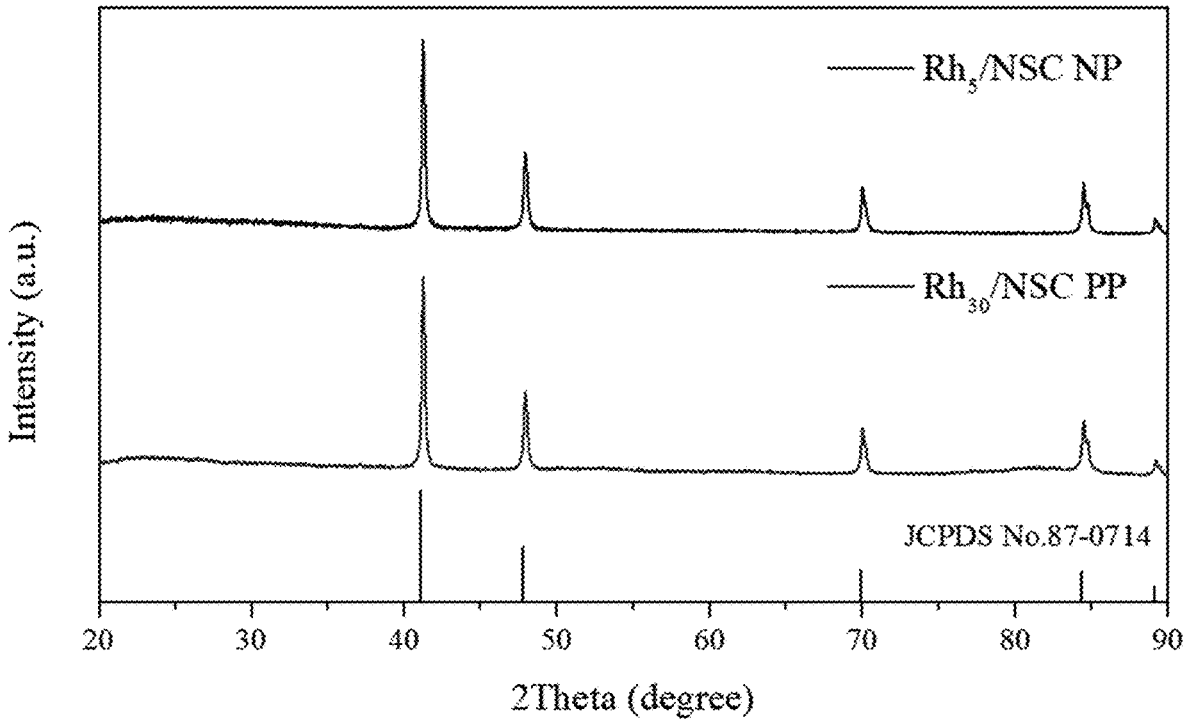
FIG. 4 depicts XRD spectra of the $Rh_5$/NSC NP and $Rh_{30}$/NSC PP.

By adjusting the precursor ratio during the preparation process, various yolk-shell nanostructures can be prepared. In one embodiment of the present invention, $Rh_5$/NSC and $Rh_{30}$/NSC nanostructures were prepared by changing the mass ratio between $RhCl_3$ and thiourea (FIG. 4). $Rh_5$/NSC and $Rh_{30}$/NSC nanostructures were prepared by using the same methods in Example 1 except for changing the feeding amount of $RhCl_3$ for 5 mg and 30 mg, respectively. The result showed that the crystallographic structure of the $Rh_5$/NSC or $Rh_{30}$/NSC nanostructures could be matched well with the standard pattern of cubic Rh phase (JCPDS NO. 87-0714).

Figure 5A:
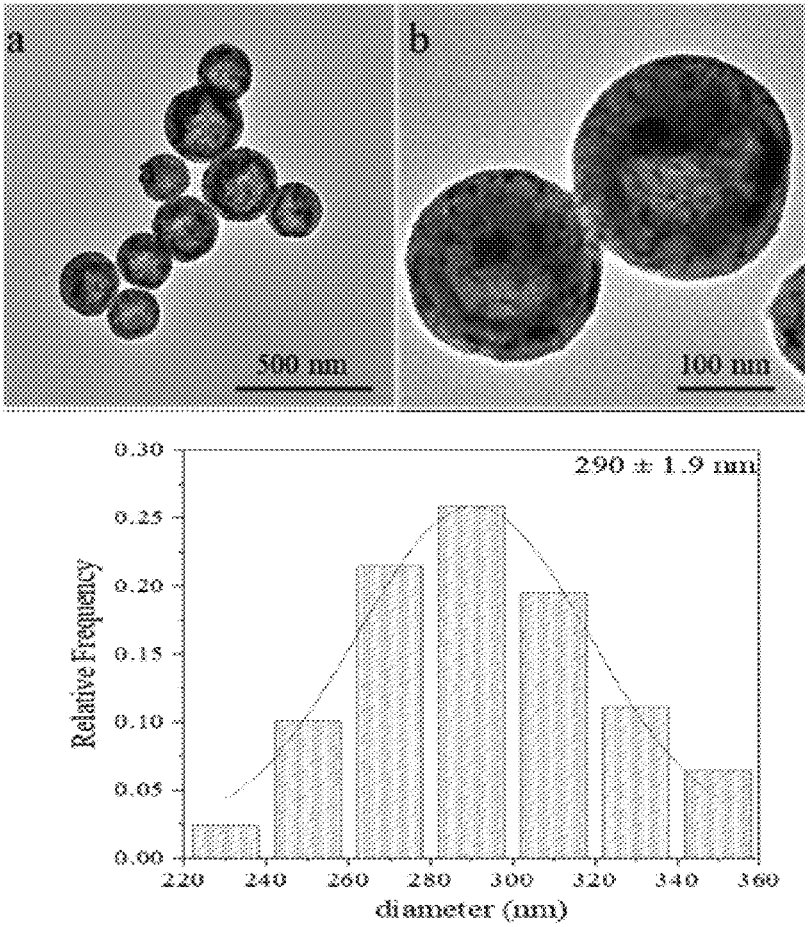
FIG. 5A shows TEM images and size distribution of the $Rh_5$/NSC NP.
Figure 5B:
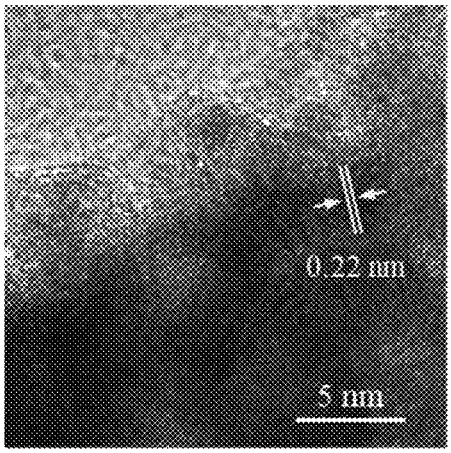
FIG. 5B shows HRTEM image of the $Rh_5$/NSC NP.
Figure 5C:
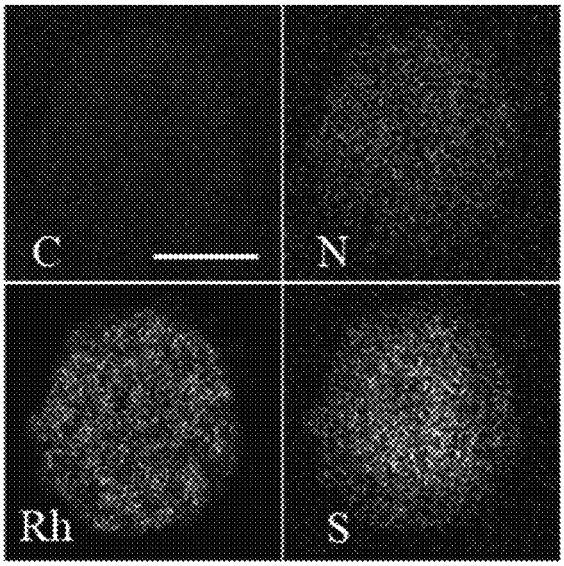
FIG. 5C shows corresponding EDS mappings of the $Rh_5$/NSC NP.
Figure 5D:
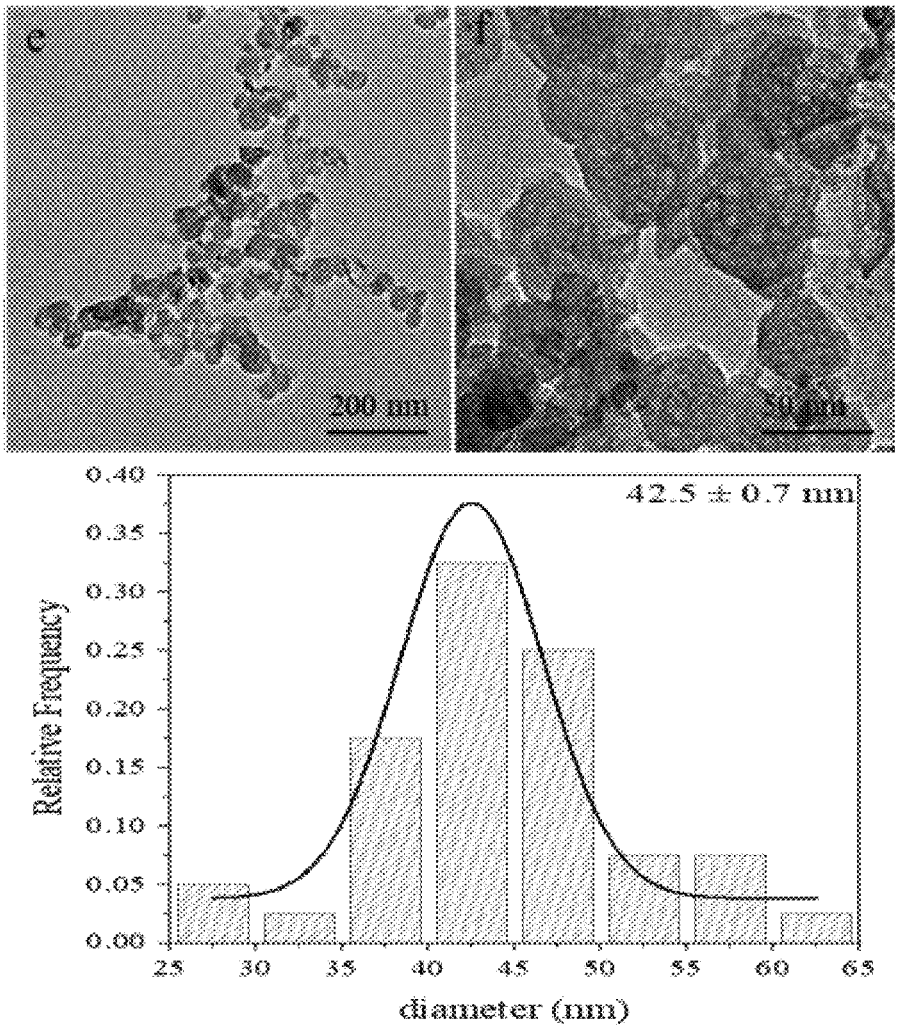
FIG. 5D shows TEM images and size distribution of the $Rh_5$/NSC PP.
Figure 5E:
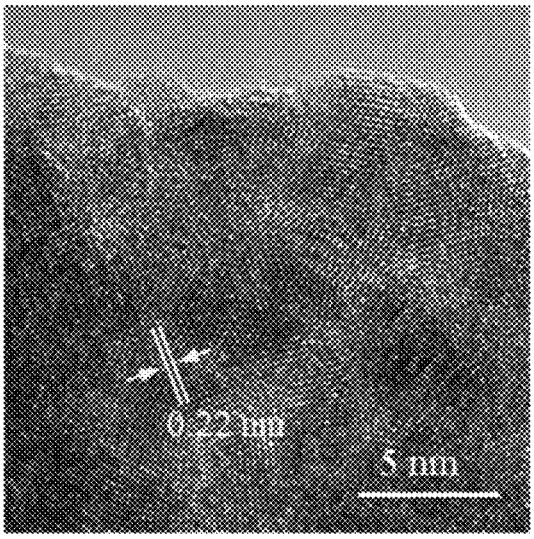
FIG. 5E shows HRTEM image of the $Rh_5$/NSC PP.
Figure 5F:
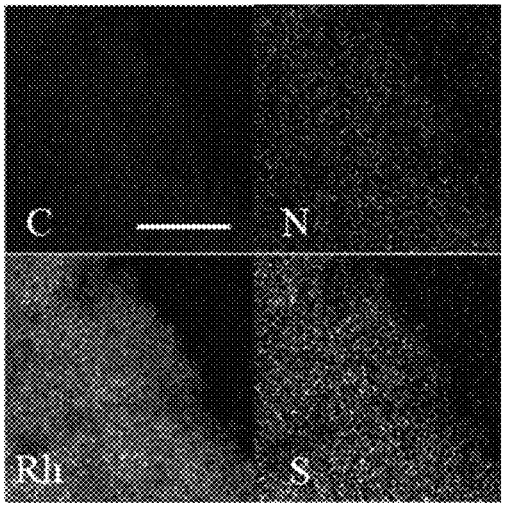
FIG. 5F shows TEM images and size distribution of the $Rh_5$/NSC PP.

In another embodiment, FIG. 5A showed that $Rh_5$/NSC YSS exhibited a typical sphere-like nanoparticle (NP) morphology with a size of 290±1.9 nm. The HRTEM image and corresponding EDS mapping revealed that the Rh atoms are evenly distributed on the N, S co-doped carbon surface (FIGS. 5B and 5C). When the Rh content was increased, the HRTEM image and corresponding EDS mapping suggested that the increased Rh content did not change the chemical composition of the product (FIGS. 5E and 5F). However, porous nanoparticles (PP) with a size of 42.5±0.7 nm were obtained (FIG. 5D).

Figure 6A:
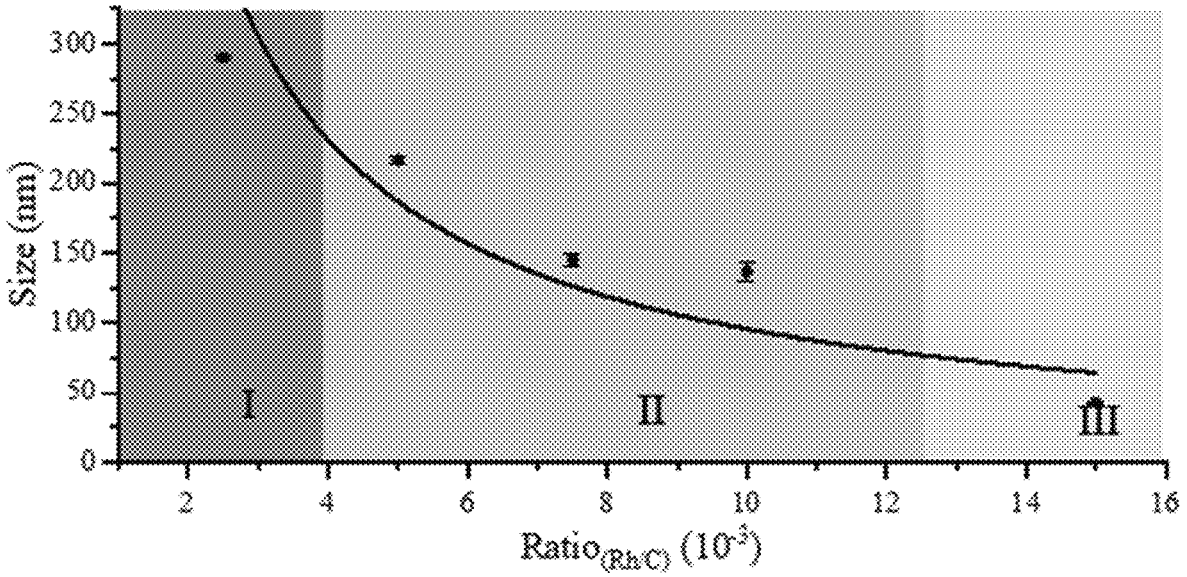
FIG. 6A depicts a relationship between size and ratio (Rh/C)
Figure 6B:
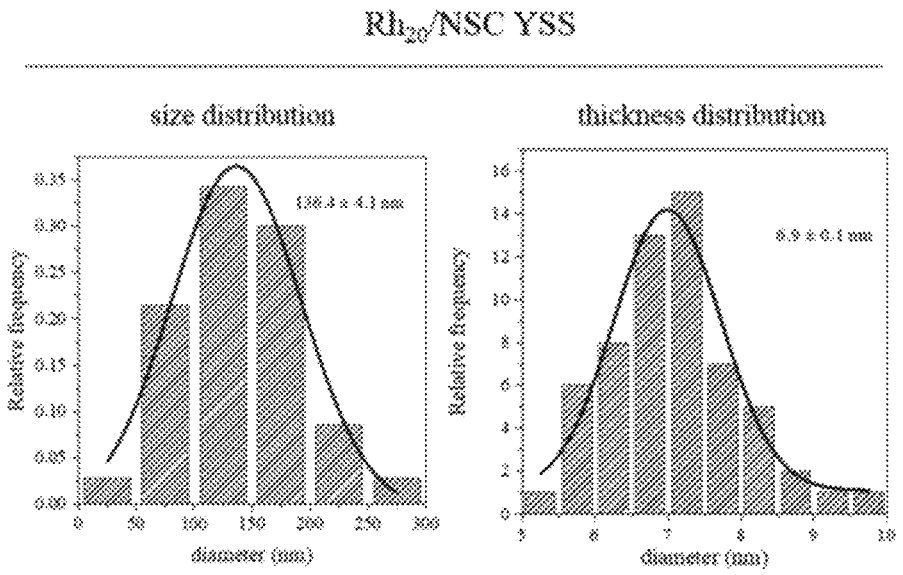
FIG. 6B depicts size distribution (left) and shell thickness distribution (right) of the $Rh_{20}$/NSC YSS.
Figure 6C:
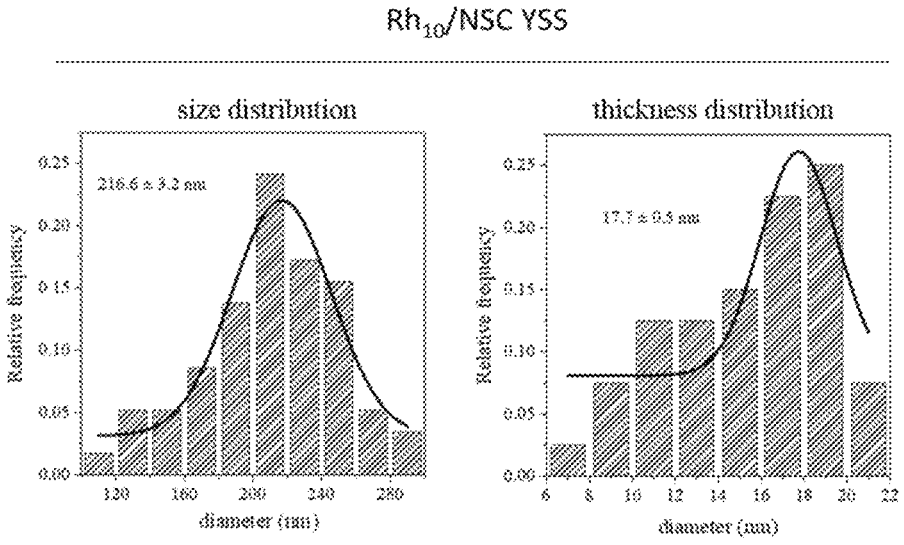
FIG. 6C depicts size distribution (left) and shell thickness distribution (right) of the $Rh_{20}$/NSC YSS.

When the Rh/C ratio was increased, the particle size would decrease exponentially. The relationship between particle size and Rh/C ratio was showed in FIG. 6A. It should be noted here, when the Rh/C ratio is 5 ($Rh_{10}$/NSC) and 10 ($Rh_{20}$/NSC), the prepared nanostructures still show the yolk-shell structure. Comparing FIGS. 6B and 6C, it can be seen that when the Rh/C ratio is increased from 5 ($Rh_{10}$/NSC) to 10 ($Rh_{20}$/NSC), the average particle size is decreased by about 38% to 136.4±4.1 nm, and the thickness is decreased by about 62% to 6.9±0.1 nm.

Example 4—Mechanism of Forming Rhx/NSC YSS

Figure 7:
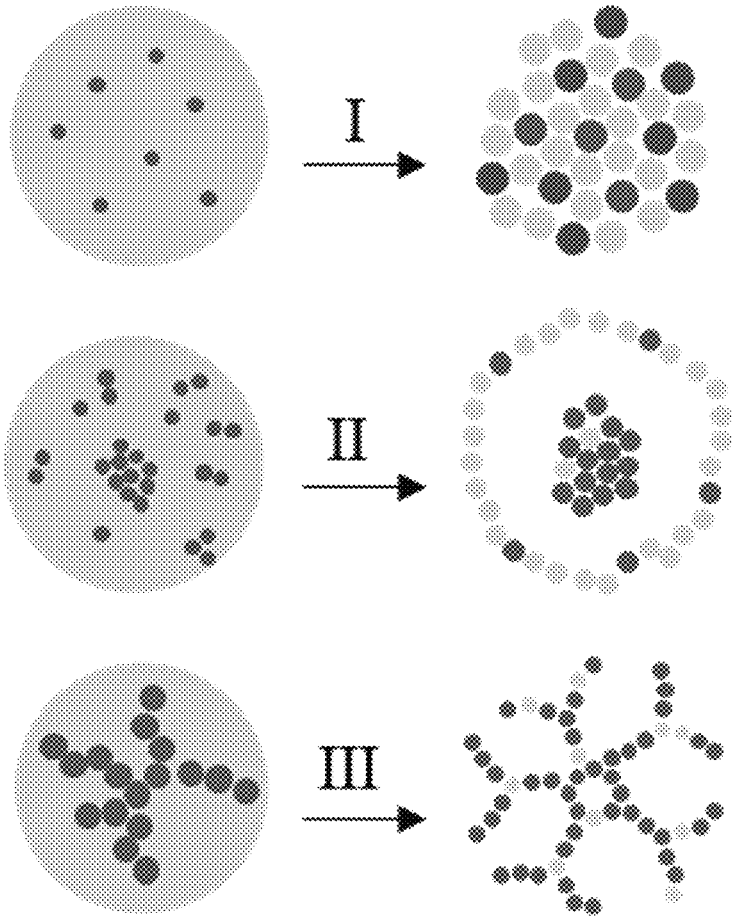
FIG. 7 shows a schematic diagram of the nanostructure formation mechanism in different stages, including NP, YSS and PP.

Based on the above characterization, FIG. 7 showed the possible formation mechanism of $Rh_x$/NSC YSS (x=5, 10, 15, 20, or 30):

(i) When the Rh/C mass ratio is low, the copolymerization reaction between $Rh^{3+}$ ions and thiourea dominates the reaction, and the reaction process is as follows:

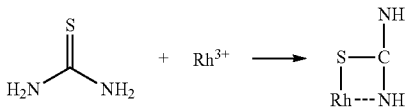

In this case, thiourea can get into carbon nanospheres in the presence of $Rh^{3+}$ ions under high temperature and pressure until the $Rh^{3+}$ ions are consumed completely. If only thiourea participates in the hydrothermal reaction during this process, no product will be obtained.

(ii) When the Rh/C mass ratio increases, $Rh^{3+}$ ions tend to perform homogeneous nucleation because of the positive redox potential of $Rh^{3+}$. Therefore, in the initial stage, the homogeneous nucleation of $Rh^{3+}$ ions dominate the reaction. When $Rh^{3+}$ ions are continuously consumed and drop to a critical value, the remaining $Rh^{3+}$ ions and thiourea repeat the stage I and proceed copolymerization reaction on the surface of the core via Rh—S bonds to form the Rh/NSC shell. Finally, under heat treatment, compared with the shell with low Rh/NSC mass ratio, the evaporation rate and volatile products of the core are more pronounced, leading to the generation of voids and the formation of Rh/NSC yolk-shell structure.

(iii) If the Rh/C mass ratio keeps increasing, the homogeneous nucleation of $Rh^{3+}$ ions dominates the reaction in the whole process. Thiourea would then participate in the reaction through copolymerization with $Rh^{3+}$ ions and acts as a structural indicator. Thus, after high-temperature carbonization treatment, a porous nanostructure is formed.

Example 5—HER Electrocatalytic Performance of $Rh_{15}$/NSC YSS

Figure 8A:
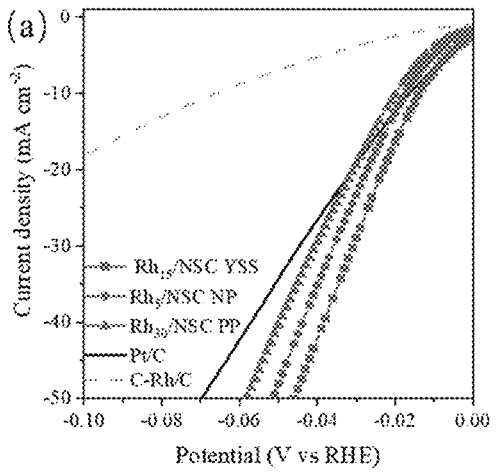
FIG. 8A depicts polarization curves of the $Rh_{15}$/NSC YSS in 1 M KOH with a scan rate of 5 mV $s^{-1}$, along with $Rh_5$/NSC NP, $Rh_{30}$/NSC PP, Pt/C and commercial Rh/C for comparison.
Figure 8B:
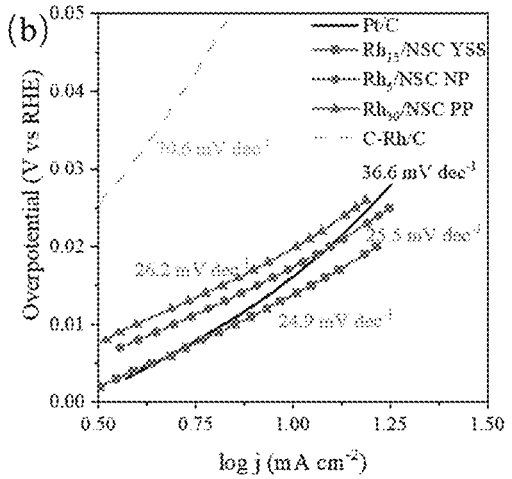
FIG. 8B depicts Tafel slope of the $Rh_{15}$/NSC YSS, along with $Rh_5$/NSC NP, $Rh_{30}$/NSC PP, Pt/C and commercial Rh/C for comparison.
Figure 8C:
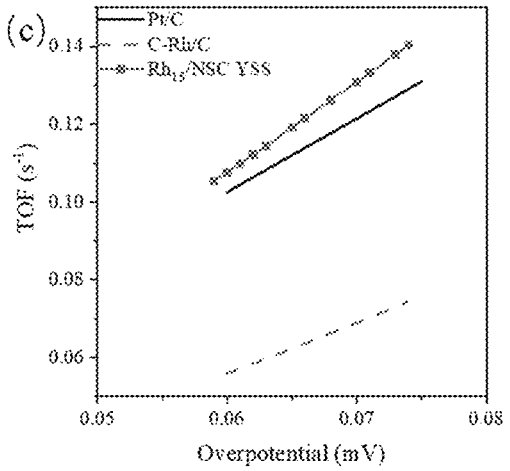
FIG. 8C depicts turnover frequency (TOF) plots of Pt/C, C—Rh/C and $Rh_{15}$/NSC YSS in the 1 M KOH electrolyte.

By using a typical three electrode system, the HER electrocatalytic performance of $Rh_{15}$/NSC YSS was next evaluated. For comparison, the data collected on $Rh_5$/NSC YSS, $Rh_{30}$/NSC YSS, commercial 20% Pt/C and commercial 5% Rh/C (C—Rh/C) were also included. Table 1 summarized the overpotential and Tafel Slope of various electrocatalysts in 1 M KOH electrolyte. Among these five samples, $Rh_{15}$/NSC YSS exhibited the best electrocatalytic performance in the 1M KOH electrolyte (pH=14), with the lowest overpotential (13.5 mV at 10 mA $cm^{-2}$) and Tafel slope (24.9 mV $dec^{-1}$), which was better than those of commercial 20% Pt/C and outperforming the state-of-the-art HER electrocatalysts (FIGS. 8A and 8B). Referring to FIG. 8C, $Rh_{15}$/NSC YSS achieved the highest TOF of 0.143 $s^{-1}$ at the overpotential of 75 mV, which was also larger than those of Pt/C (0.131 $s^{-1}$) and C—Rh/C (0.075 $s^{-1}$).

TABLE 1

Electrocatalytic performance comparison between $Rh_x$/NSC YSS (x = 5, 15, 30) and state-of-the-art noble metal based electrocatalysts

| Catalysts | Overpotential (mV) (j = 10 mA $cm^{-2}$) | Tafel Slope (mV $dec^{-1}$) | Electrolyte | Reference |
|---|---|---|---|---|
| $Rh_{15}$/NSC | 13 | 24.9 | 1M KOH | This work |
| $Rh_5$/NSC | 17 | 25.5 | 1M KOH | This work |
| $Rh_{30}$/NSC | 20 | 26.2 | 1M KOH | This work |
| Commercial Pt/C | 17 | 36.6 | 1M KOH | This work |
| Ru/$C_2N$ | 17 | 38 | 1M KOH | *Nature Nanotechnology*, 2017, 12, 441. |
| Pt dendrite | 30 | 34 | 1M KOH | *J. Mater. Chem. A*, 2018, 6, 8068. |
| Ru ND/C | 43.4 | 49 | 1M KOH | *Chem. Commun.*, 2018, 54, 4613 |
| Ru—Mo | 39 | 31 | 1M KOH | *J. Mater. Chem.* A, 2017, 5, 5475 |
| Ru/NG | 40 | 76 | 1M KOH | *Sustainable Energy* Fuels, 2017, 1, 1028 |

TABLE 1-continued

Electrocatalytic performance comparison between $Rh_x$/NSC YSS (x = 5, 15, 30) and state-of-the-art noble metal based electrocatalysts

| Catalysts | Overpotential (mV) (j = 10 mA $cm^{-2}$) | Tafel Slope (mV $dec^{-1}$) | Electrolyte | Reference |
|---|---|---|---|---|
| Ru/NC | 21 | 31 | 1M KOH | *J. Mater. Chem. A*, 2017, 5, 25314 |
| RuCo | 34 | 36 | 1M KOH | *J. Mater. Chem. A*, 2020, 8, 12810 |
| IrCo | 45 | 80 | 1M KOH | *Adv. Mater.*, 2018, 30, 1705324. |
| Ru@GaP | 22 | 28 | 1M KOH | *Adv. Mater.*, 2018, 30, 1803676 |
| PdPt | 46 | 88 | 1M KOH | *Int. J. Hydrog. Energy*, 2020, 45, 11127. |
| Pt/RuNi | 38 | 39 | 1M KOH | *Appl. Catal. B*, 2020, 269,118824. |
| Au@AgPt | 20 | 30 | 1M KOH | *Int. J. Hydrog. Energy*, 2017, 42, 30208 |
| Pt/CDots | 56 | 58 | 1M KOH | *Appl. Catal. B*, 2019 257,117905 |

Figure 8D:
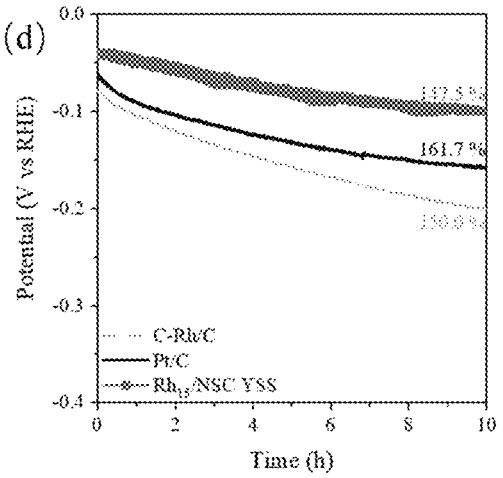
FIG. 8D depicts time-dependent current density plots versus time without iR correction at a static current density (10 mA $cm^{-2}$)

Furthermore, the $Rh_{15}$/NSC YSS also displayed long-term stability with a degradation rate of 147.5% during 10 hours, which was better than the ones of Pt/C (161.7%) and C—Rh/C (150.0%), verifying the promotion effect of yolk-shell nanostructure to stabilize architectural morphology and effectively avoids the coverage of active sites during reaction (FIG. 8D).

The above data have proved that hydrogen binding energy (HBE) provides a key descriptor for HER activity. The enhanced HER intrinsic activity of $Rh_{15}$/NSC YSS can be ascribed to a weaker H chemisorption strength as compared to Pt/C, triggering the acceleration of the hydrogen desorption step.

Figure 8E:
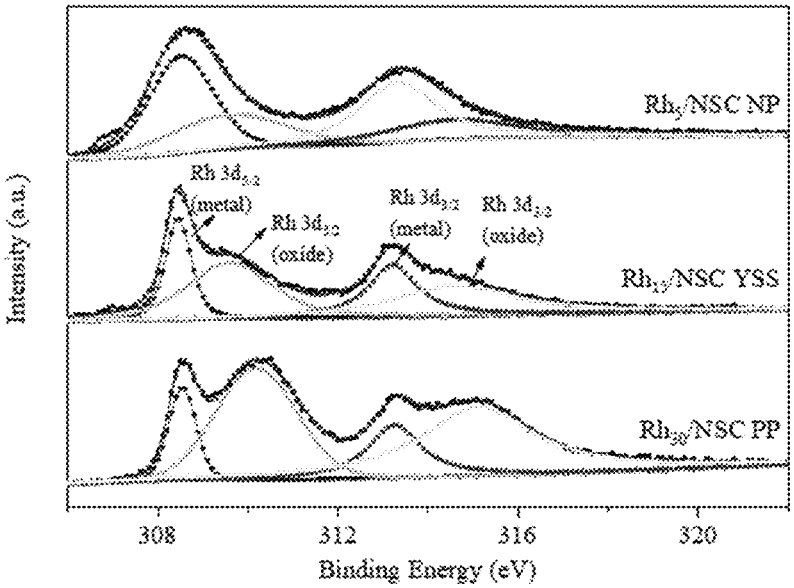
FIG. 8E depicts XPS spectra of the $Rh_5$/NSC NP, $Rh_{15}$/NSC and $Rh_{30}$/NSC PP.

Also, the X-ray photoelectron spectroscopy (XPS) showed that when the Rh/C mass ratio was increased, the percentage of oxidized Rh (located at 309.8 eV and 314.8 eV) improved obviously (FIG. 8E), indicating that the electronic structure of active sites can be controlled via changing the Rh/C mass ratio.

Figure 8F:
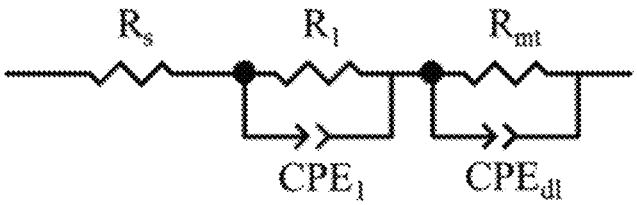
FIG. 8F depicts an equivalent circuit used to fit the EIS data.

Moreover, electrochemical impedance spectroscopy (EIS) analyses of the nanostructures have been employed to further understand the reaction kinetics for HER with equivalent circuit depicted in FIG. 8F. $R_s$ is the overall series resistance. $CPE_1$ and $R_1$ are the constant phase element and resistance describing electron transport at substrate/catalyst interface, respectively. $CPE_{dl}$ is the constant phase element of the catalyst/electrolyte interface, and $R_{mt}$ is the mass-transfer resistance at catalyst/electrolyte interface. The semi-circles in the high-frequency range and low-frequency range are associated with charge-transfer resistance ($R_{ct}$) and mass-transfer resistance ($R_{mt}$), respectively. The elements of the value in the equivalent circuit are summarized in Table 2. Among these three samples, it can be seen that $Rh_{15}$/NSC YSS exhibits the lowest $R_{ct}$ (8.37Ω) and $R_{mt}$ (1.74Ω), indicating a faster HER process.

TABLE 2

Values of the elements in the equivalent circuit

| Catalysts | $R_s$ (Ω) | $Q_1$ ($F \cdot cm^{-2} \cdot S^{n-1}$) | $n_1$ | $R_1$ (Ω) | $Q_{dl}$ ($F \cdot cm^{-2} \cdot S^{n-1}$) | $n_{dl}$ | $R_{mt}$ (Ω) |
|---|---|---|---|---|---|---|---|
| $Rh_5$/NSC NP | 3.96 | $1.38 \times 10^{-3}$ | 0.69 | 6.39 | $6.1 \times 10^{-3}$ | 1.23 | 2.41 |
| $Rh_{15}$/NSC YSS | 3.87 | $5.56 \times 10^{-4}$ | 0.76 | 4.50 | $1.5 \times 10^{-2}$ | 1.00 | 1.74 |
| $Rh_{30}$/NSC PP | 4.20 | $3.5 \times 10^{-4}$ | 0.78 | 8.68 | $7.1 \times 10^{-3}$ | 0.92 | 5.47 |

Note:
the charge-transfer resistance ($R_{ct}$) = the sum of $R_s$ and $R_1$ in the equivalent circuit.

Example 5—Effect on Electrochemical Surface Area (ECSA)

To evaluate the electrochemical surface area of the prepared nanostructures, the electrochemical double-layer capacitances ($C_{dl}$) of the products were measured via a simple cyclic voltammetry (CV) method, and therefore the electrochemical surface area can be estimated according to the following formula:

$$ECSA = C_{dl} \cdot Cs,$$

Figure 9:
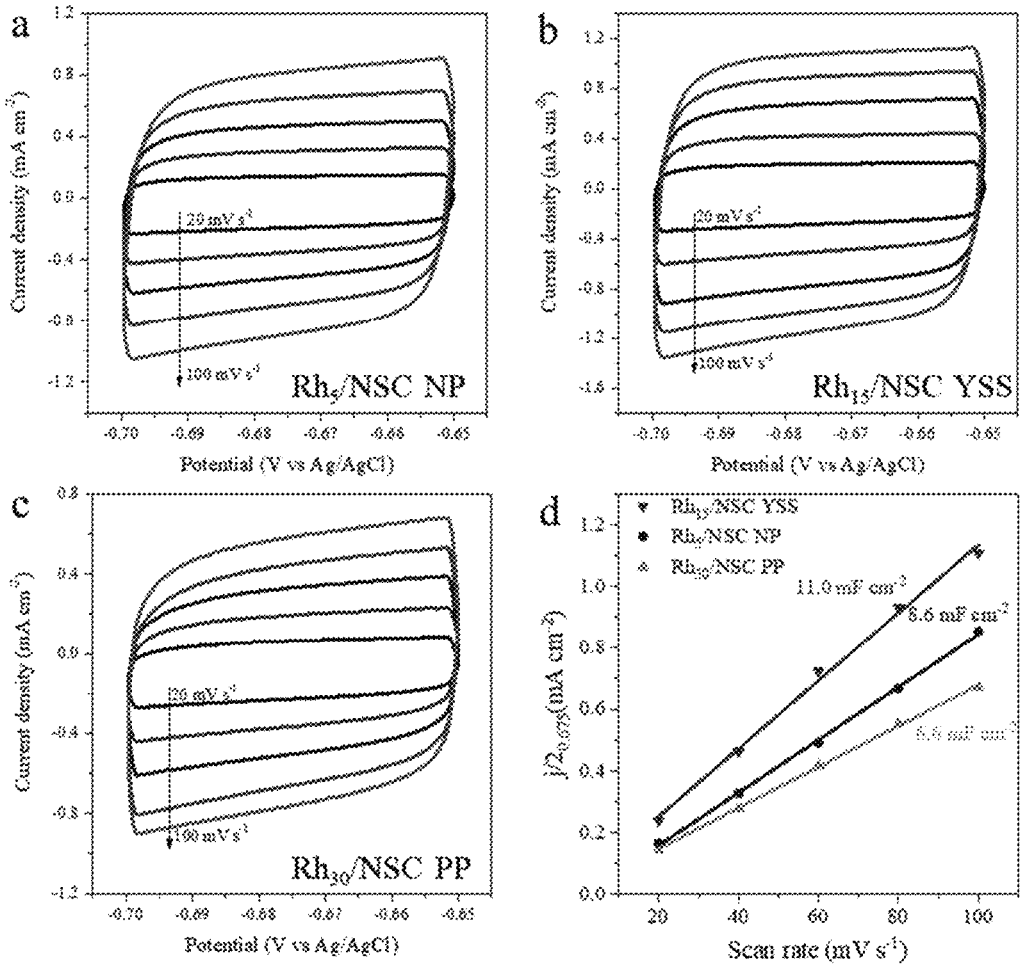
FIG. 9 depicts cyclic voltammograms (CVs) of $Rh_5$/NSC YSS, $Rh_{15}$/NSC YSS and $Rh_{30}$/NSC YSS in the potential range from −0.70 to −0.65 V (vs RHE) without redox current peaks in 1 M KOH electrolyte, and a plot of current density difference $(\Delta j = j_a - j_c)/2$ at −0.675 V plotted against the scan rate.

Cs means specific capacitance; and $C_{dl}$ means capacitance. In the present invention, Cs is the same value for all three samples. Thus, ECSA changes can be compared from $C_{dl}$. As shown in FIG. 9, the $Rh_{15}$/NSC YSS exhibits the largely increased ECSA, which can be attributed to the optimized electronic structure of the Rh active centers.

Figure 10:
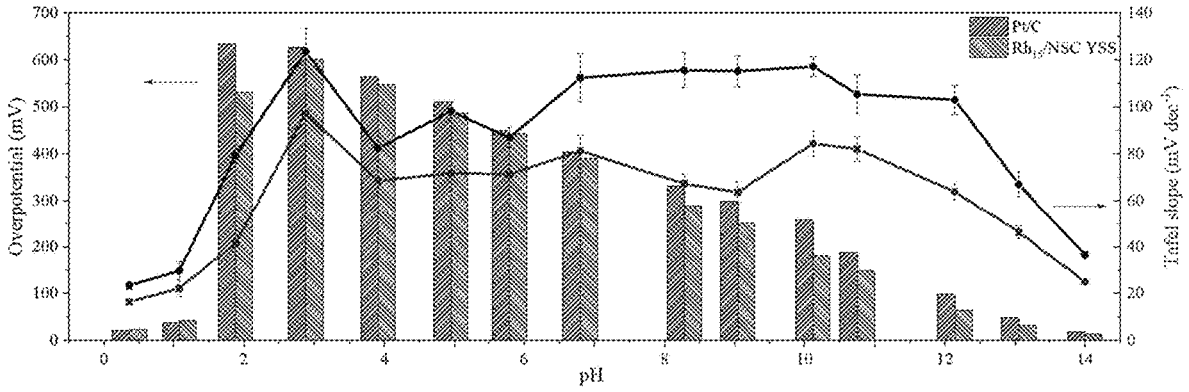
FIG. 10 depicts the variation of Tafel slopes and overpotential (10 mA $cm^{-2}$) of $Rh_{15}$/NSC YSS and Pt/C catalysts with the pH values (0 to 14)

Example 6—Electrocatalytic Performance of $Rh_{15}$/NSC YSS Across all pH Ranges An ideal HER electrocatalyst should possess excellent performance over a wide pH value, even at all pH values. FIG. 10 records the overpotential (current density is 10 mA $cm^{-2}$) and corresponding Tafel slopes of the electrocatalysts in the whole pH range. In specific, $Rh_{15}$/NSC YSS shows a faster kinetic process than that of Pt/C in all the electrolyte of different pH values. Therefore, even in the strong acid condition (pH=0.36 and 1.08) where the overpotential of $Rh_{15}$/NSC YSS exceeds that of Pt/C, $Rh_{15}$/NSC YSS still exhibits a higher electrocatalytic performance than Pt/C.

Example 7—Hydrophilicity of Different $Rh_x$/NSC YSS

Figure 11A:
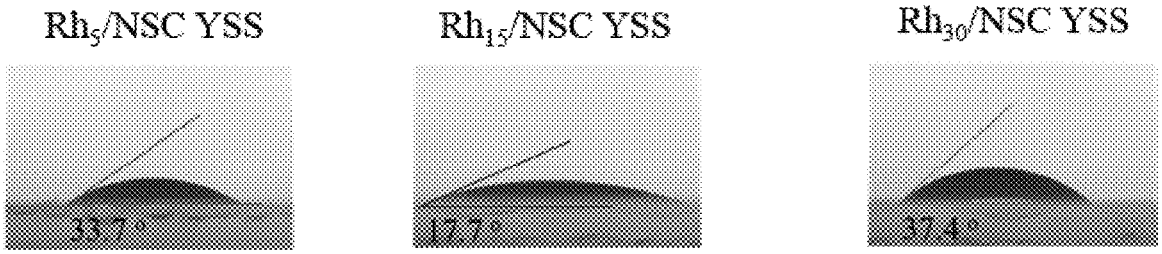
FIG. 11A shows the water contact angle measurement images of $Rh_5$/NSC YSS NP, $Rh_{15}$/NSC YSS NP and $Rh_{30}$/NSC YSS PP.
Figure 11B:
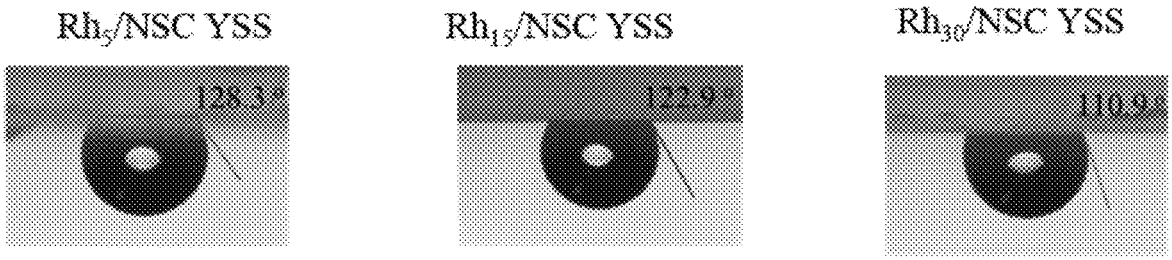
FIG. 11B shows the bubble contact angle measurement images of $Rh_5$/NSC YSS NP, $Rh_{15}$/NSC YSS NP and $Rh_{30}$/NSC YSS PP.

Water and gas contact angle were tested by Dataphysics Contact Angel Tester. In addition to having improved electrocatalytic performance, the $Rh_{15}$/NSC YSS also exhibits the best hydrophilicity among three kinds of nanostructures, which can be contributed to the existence of capillary force in the small voids. The capillary force would significantly improve the electrolyte infiltration into the voids compared with NP and PP nanostructures, resulting in a smaller contact angle with electrolytes (FIG. 11A). Also, the $Rh_{15}$/NSC YSS exhibits the excellent aerophobicity, which is beneficial for the $H_2$ desorption (FIG. 11B).

Example 8—Gas Bubbles Release Behavior of Different $Rh_x$/NSC YSS

Figure 11C:
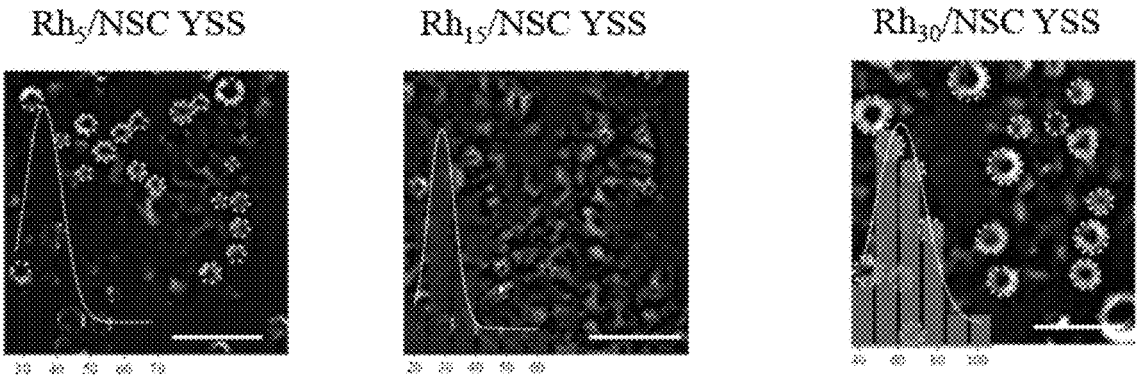
FIG. 11C shows digital photos of the hydrogen bubbles produced on the surface of three electrocatalysts during HER at −0.05 V vs. RHE. Insets show the statistics on the gas bubble size distribution. All scale bars are 500 mm.

To gain a further insight into the effect of nanostructures on the HER performance, the gas bubbles release behavior is further investigated during the in-situ electrochemical process. Taking the HER recorded at −0.05 V (vs RHE) as an example, hydrogen bubbles escaped easily from the $Rh_{15}$/NSC YSS surface with a size of 28.7±0.1 nm that are obviously smaller than those of $Rh_5$/NSC YSS NP (36.0±2.7 nm) and $Rh_{30}$/NSC YSS PP (61.2±2.1 nm) (FIG. 11C).

Figure 11D:
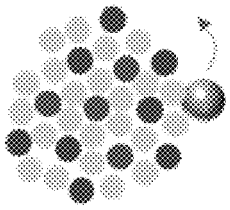
FIG. 11D shows a schematic diagram of gas bubbles formation and release process on the surface of three electrocatalysts.
Figure 11D:
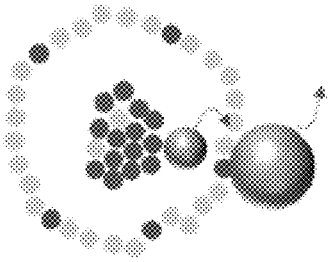
Figure 11D:
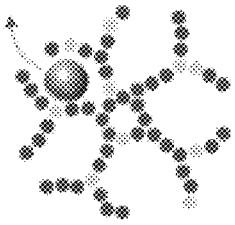

This phenomenon is closely related to the gas bubbles nucleation, transfer and desorption process. Specifically, for the $Rh_5$/NSC YSS NP electrocatalyst, typical gas bubbles behavior is occurred on the surface. The bubbles nucleate and grow on the active sites, and after reaching the critical size, they will directly desorb and diffuse into the electrolyte (FIG. 11D, top).

While for the $Rh_{15}$/NSC YSS, compared with the larger bubbles generating on the outer shell, more gas bubbles are quickly generated and restricted on the surface of the core part because of the spatial confinement effect and heterogeneous composition. Based on the Young-Laplace equation:

$$P_s = 2\gamma/R,$$

$P_s$ presents the pressure and R is the radius of curvature, the pressure of a bubble is inversely proportional to its radius. The small gas bubbles inside can diffuse into the large bubbles easily through the shell because of the pressure difference, then bubbles on the outside will be quickly released. The ion transfer rate is positively correlated to the rate of gas escape; hence, the rapid desorption of gas bubbles for $Rh_{15}$/NSC YSS is beneficial for accelerating the catalytic reaction (FIG. 11D, middle).

For the $Rh_{30}$/NSC YSS, the generated gas bubbles are easily trapped in the porous channel, covering the active sites and reducing the catalytic performance (FIG. 11D, bottom).

Materials and Methods

Electrochemical Measurements:

For electrochemical measurement, the well-dispersed catalyst ink was prepared by ultrasonication with 3 mg of fabricated electrocatalyst, 50 μL of distilled water, 170 μL of ethanol, 10 μL of Nafion for 2 hours. Then, 5 μL of the catalyst ink was pipetted onto the glass carbon electrode surface (5 mm in diameter, S=0.19625 $cm^2$). All electrochemical characterization was investigated with a Gamry 300 electrochemical workstation connected with a standard three-electrode configuration under 25° C. using a constant temperature bath. The fabricated electrode sample was used as the working electrode. A saturated calomel electrode (SCE) and a carbon rod were employed as the reference electrode and counter electrode, respectively. All the reported potentials were calibrated versus the reversible hydrogen electrode (RHE) using the equation of $E_{RHE}=E_{SCE}+(0.2415+0.059\times pH)$ V, where $E_{RHE}$ is the potential referred to RHE and $E_{SCE}$ is the measured potential against the SCE reference electrode. The electrochemical activity of the samples towards HER and OER were surveyed in 1M KOH aqueous solution (pH=14) by linear sweep voltammetry (LSV) at a scan rate of 5 mV $s^{-1}$. To keep the electrode surface in a relatively stable state, several cyclic voltammetry (CV) cycles were operated before the assessment of electrochemical activity until the hydrogen evolution currents showed the unnoticeable change. Unless otherwise mentioned, the voltammograms were recorded with the iR drop compensation automatically on the workstation. Electrochemical impedance spectroscopy (EIS) was conducted at 1.5 V (vs. RHE) over a frequency range of between 0.05 Hz and 100 kHz at 5 mV $s^{-1}$.

Calculation of TOF:

Turnover frequency (TOF) is calculated from the equation of $$TOF = \frac{I \times A}{2 \times F \times n},$$

where I is the current density, A is the exposed surface area of the electrocatalyst, F is the Faradic constant and n is the moles of the active materials. Herein, the noble metal atoms for each catalyst loaded on the glass carbon electrode are considered as active sites.

Preparation of Electrolytes:

The electrolyte was prepared as follows; as seen from the electrolytes below, all pH values from alkaline to acidic are covered in the present invention:

$$0.5M\ H_2SO_4\ (pH = 0.36),$$

$$0.05M\ H_2SO_4 + 0.45M\ Na_2SO_4\ (pH = 1.08),$$

$$5\ mM\ H_2SO_4 + 0.49M\ Na_2SO_4\ (pH = 1.88),$$

$$0.5\ mM\ H_2SO_4 + 0.49M\ Na_2SO_4\ (pH = 2.88),$$

$$0.05\ mM\ H_2SO_4 + 0.49M\ Na_2SO_4\ (pH = 3.91),$$

$$5\ mM\ H_2SO_4 + 0.49M\ Na_2SO_4\ (pH = 4.95),$$

-continued 0.5 mM $H_2SO_4$ + 0.49M $Na_2SO_4$ (pH = 5.79), 0.5M $Na_2SO_4$ (pH = 6.8), 1M KOH (pH = 14), 0.1M KOH+0.6M $K_2SO_4$ (pH = 13.05), 0.01M KOH + 0.66M $K_2SO_4$ (pH = 12.14), 1 mM KOH + 0.66M $K_2SO_4$ (pH = 10.75), 0.1 mM KOH + 0.66M $K_2SO_4$ (pH = 10.12), 0.01 mM KOH + 0.66M $K_2SO_4$ (pH = 9.04), 1 mM KOH + 0.66M $K_2SO_4$ (pH = 8.28).

The description of the present invention has been provided for the purposes of illustration and description. It is not intended to be exhaustive or to limit the invention to the precise forms disclosed. The embodiments were chosen and described in order to best explain the principles of the invention and its practical application, thereby enabling others skilled in the art to understand the invention for various embodiments and with various modifications that are suited to the particular use contemplated.

One skilled in the art would readily appreciate that different functions discussed herein may be performed in a different order and/or concurrently with each other. Many modifications and variations will be apparent to the practitioner skilled in the art. Furthermore, if desired, one or more of the embodiments described herein may be optional or may be combined. Other aspects and advantages of the present invention will be apparent to those skilled in the art from a review of the present application.

INDUSTRIAL APPLICABILITY

The present invention relates to heterogeneous yolk-shell nanostructure with Rh nanoparticles embedded in S, N co-doped carbon nanostructures. The obtained yolk-shell nanostructures can serve as an efficient and stable hydrogen evolution reaction electrocatalysts in all pH values, which can be applied to electrochemical hydrogen evolution reaction, hydrogen fuel cells, optical sensors, and gas purification (including CO and NOx reduction).

The invention claimed is:

1. A yolk-shell nanostructure, comprising:

a yolk core comprising Rh nanoparticles; and a carbon shell encapsulating the yolk core, wherein the carbon shell is co-doped with sulfur and nitrogen nanoparticles, and wherein the yolk-shell nanostructure has an overpotential of 10 to 20 mV at 10 mA $cm^{-2}$, a Tafel slope of 20 to 30 mV $dec^{-1}$, a TOF of 0.1 to 0.3 $s^{-1}$, at −75 mV/RHE, and a durability more than 10 hours.

2. The yolk-shell nanostructure according to claim 1, wherein the yolk-shell nanostructure has a particle size of 1-300 nm.

3. The yolk-shell nanostructure according to claim 2, wherein the yolk-shell nanostructure has a particle size of 30-250 nm.

4. The yolk-shell nanostructure according to claim 1, wherein the yolk-shell nanostructure has a water contact angle between 10 degrees to 40 degrees.

5. The yolk-shell nanostructure according to claim 4, wherein the yolk-shell nanostructure has a water contact angle between 10 degrees to 20 degrees.

6. The yolk-shell nanostructure according to claim 1, wherein the thickness of the yolk-shell nanostructure is in a range of 1 to 10 nm.

7. A method for fabricating a yolk-shell nanostructure, comprising:

separately dissolving a rhodium salt in a solvent and thiourea in a solvent to form a rhodium salt solution and a thiourea solution;

adding the rhodium salt solution to the thiourea solution under agitation to obtain a mixture solution;

performing a hydrothermal reaction on the mixture solution;

cooling the solution to room temperature and recovering precipitates from the solution and washing the precipitates;

drying the precipitates; and transforming the precipitates into a yolk-shell nanostructure by heat treating.

8. The method according to claim 7, wherein a mass ratio between rhodium salt and thiourea is in a range of 15:1 to 2:1.

9. The method according to claim 7, wherein a working temperature during the hydrothermal reaction is in a range of 120° C. to 180° C.

10. The method according to claim 7, wherein a working time for the hydrothermal reaction is in a range of 1 to 48 hours.

11. The method according to claim 7, wherein the step of drying the precipitates is performed at a temperature of 50° C. to 70° C.

12. The method according to claim 7, wherein a working temperature for the heat treating is in a range of 300° C. to 800° C.

13. The method according to claim 7, wherein a working time for the heat treating is in a range of 1 to 48 hours.

14. The method according to claim 7, wherein the heat treating comprises a heating rate of 2° C. $min^{-1}$.

15. The method according to claim 7, wherein the rhodium salt is rhodium chloride.

16. The method according to claim 7, wherein the solvent is water.

* * * * *